United States Patent [19]

Rocheleau

[11] Patent Number: 4,474,496

[45] Date of Patent: Oct. 2, 1984

[54] COMPACT DRYER FOR TWO WEB STRETCHES

[75] Inventor: Michael O. Rocheleau, Green Bay, Wis.

[73] Assignee: W. R. Grace & Company, New York, N.Y.

[21] Appl. No.: 460,315

[22] Filed: Jan. 24, 1983

[51] Int. Cl.[3] ..... F26B 13/00; F27B 9/28; F24H 1/00

[52] U.S. Cl. ..... 432/59; 34/156; 432/222

[58] Field of Search ..... 432/59, 222; 34/156

[56] References Cited

U.S. PATENT DOCUMENTS

| | | | |
|---|---|---|---|
| 2,695,252 | 11/1954 | Nickelsen et al. | 34/186 |
| 3,151,954 | 10/1964 | Ege | 34/229 |
| 3,371,427 | 5/1968 | Thygeson | 34/219 |
| 3,473,972 | 10/1969 | Arnold et al. | 432/222 |
| 3,559,301 | 2/1971 | Fraser | 34/156 |
| 3,964,656 | 6/1976 | Hella | 34/56 |
| 4,341,024 | 7/1982 | Witkin | 34/156 |
| 4,425,715 | 1/1984 | Klein et al. | 34/156 |

*Primary Examiner*—John J. Camby
*Attorney, Agent, or Firm*—James E. Nilles

[57] ABSTRACT

A web dryer for upper and lower stretches of horizontally extending lengthwise moving web, having stacked air bar assemblies of the compact type, has a single burner for supplying hot gases to the two air bar assemblies that are between the stretches. The burner projects into an inlet section of a T-shaped duct, which has branches terminating at a pair of outlets, each opening to, but spaced from, the air inlet of the blower for one of said two assemblies. A deflector plate in the inlet section of the T-shaped duct, swingable about an upright axis at the downstream end of that section, apportions burner combustion products between the branches. The burner is controlled by a thermostat in the header of the lower of said two assemblies, the deflector plate by a thermostat in the header of the upper of said two assemblies.

10 Claims, 5 Drawing Figures

COMPACT DRYER FOR TWO WEB STRETCHES

FIELD OF THE INVENTION

This invention relates to apparatus for drying lengthwise moving web material, comprising a dryer enclosure in which there are upper and lower horizontally extending stretches of web that are superimposed by vertically spaced apart and air bar assemblies from which air is emitted against both surfaces of each stretch to floatingly support it; and the invention is more particularly concerned with apparatus wherein each air bar assembly comprises an elongated header having air bars at intervals along its length and having a blower at one of its ends, wherein there is one such assembly above the lower web stretch and another below the upper one and the blowers of those two assemblies are at their ends remote from one another, and wherein heated air is delivered to the blowers of both of those assemblies from a single burner.

BACKGROUND OF THE PRIOR ART

The copending U.S. patent application of D. M. Klein et al, Ser. No. 357,848, now U.S. Pat. No. 4,425,719, filed Mar. 15, 1982, which has a common assignee with this application, discloses web drying apparatus comprising air bar assemblies of unprecedented compactness. The present invention is concerned with an improvement which is particularly useful in web dryers comprising such air bar assemblies.

An air bar assembly made in accordance with that patent application comprises an elongated header which extends lengthwise of a stretch of web to be dried and which has transversely extending air bars at regular intervals along its length, each communicated with the interior of the header through a port midway between its ends. Each such air bar assembly has its own blower, located at a rear end of the header, by which pressure air is forced into the header for emission from the air bars along it. There is one such assembly below each stretch of web, and another one above the stretch. From the air bar assembly below the web stretch air issues upwardly against the stretch to levitate it, while the stretch is steadied and guided by air issuing downwardly against it from the air bar assembly above it. The air streams thus directed against the web effect rapid drying of it.

An air bar assembly of said copending application comprises pressure air distributing means for ensuring uniform emission of air from all air bars along the length of the header, notwithstanding that some of the air bars are mounted on the rear portion of the header, directly opposite the blower, whereas others are at the front end of the header and thus at some distance from the blower. Reference can be made to that application for all details of this pressure air distributing means.

For optimum compactness and versatility, air bar assemblies of the copending application are preferably incorporated in a dryer that accommodates two or more horizontal stretches of web, disposed one above the other. The respective stretches may be those of different webs, or one web may be guided along a sinuous path to make repeated passes through the dryer enclosure in which the air bar assemblies are housed. In either case, vertical height of the dryer is minimized by arranging the two air bar assemblies that are between web stretches with their headers in front-to-rear relationship to one another so that their blowers are lengthwise remote from one another. With the air bar assemblies so disposed, a dryer enclosure that compactly houses them has relatively little space in its interior to accommodate fuel burners by which air is heated and ducting by which the heated air is conducted to the several blowers. Furthermore, if there is a burner for every air bar assembly, to provide for individual control of the temperature in each header, the rear wall of the dryer enclosure, on which the burners and their controls are mounted, becomes extremely cluttered, and there may be a certain amount of difficulty in finding room for all of the burners.

It is apparent that these problems can be overcome by an arrangement wherein one burner serves as a source of heated air for two air bar assemblies, and particularly the two air bar assemblies that are between web stretches, inasmuch as there is a minimum of space between and around those two assemblies. Using one burner for those two air bar assemblies has the obvious further advantage of saving the cost of a fuel burner.

However, sharing the output of one burner between two air bar assemblies gives rise to certain problems. Usually, the air directed against the lower one of a pair of web stretches in a dryer enclosure should be at a higher temperature than the air emitted against the upper stretch, although there can be times when it is desired to maintain the same air temperature at both stretches. This poses the problem of how to have cooler air in the header of the lower air bar assembly for the upper web stretch than in the header of the upper air bar assembly for the lower stretch, when both of those headers are supplied with heated air from the same burner. The problem is complicated by the fact that it must be possible to maintain a desired temperature in each of those two headers, even though the desired temperatures may differ substantially from one another, and even though the temperature to be maintained in each header must be adjustably variable independently of the temperature to be maintained in the other. As brought out in the introductory paragraphs of U.S. Pat. No. 3,151,954, issued to B. C. Ege in 1964, the problem is further complicated by the requirement that changing the temperature in a particular header must not bring about a change in the rate of air flow through the header.

SUMMARY OF THE INVENTION

The general object of this invention is to provide web drying apparatus comprising a dryer enclosure in which there are horizontally extending upper and lower web stretches, air bar assemblies of the type disclosed in the aforesaid patent application that are arranged for floatingly supporting those web stretches, and means for heating air and delivering it to the air bar assemblies, wherein said means for heating and delivering air is compact enough to fit within the dryer enclosure without requiring any substantial increase in enclosure dimensions for its accommodation, and is so arranged as not to clutter the back wall of the enclosure where the burners and their controls are mounted.

A more specific object of this invention is to provide web drying apparatus having air bar assemblies of the type comprising an elongated header for each assembly, a plurality of air bars on each header, spaced at intervals along it and communicated with its interior, and a blower for each header for providing pressure air to all of the air bars along the header, each blower being located at a rear end of its header, said web drying apparatus having its air bar assemblies arranged for floating support of upper and lower horizontally extending web stretches and having a pair of air bar assemblies between the web stretches whereof each has its blower adjacent to the front end of the header of the other, said drying apparatus having a single burner for supplying heated air to the headers of said pair of air bar assemblies and having simple means for individually and independently controlling the temperatures in those headers.

It is also an important object of this invention to provide drying apparatus of the character just described, having means for delivering heated air to the air bar assemblies between web stretches in such a manner that the rate of air flow through the header of each air bar assembly is unaffected by the temperature maintained in the header.

These and other objects of the invention that will appear as the description proceeds are achieved in a web dryer comprising enclosure means defining a drying chamber wherein there are horizontally extending upper and lower stretches of lengthwise moving web that are in superimposed but vertically spaced relationship, said drying chamber having therein a plurality of elongated headers, each having ports at intervals along its length through which heated pressure air can issue from its interior towards a stretch of web, there being a pair of said headers whereof one is below the upper stretch and has upwardly opening ports and the other is above the lower stretch and has downwardly opening ports, and every header having a blower at a rear end of it for feeding pressure air into it, the headers of said pair being arranged with the blower of each adjacent to the front end of the other and with air inlets of their blowers opening in one direction to one side of them. The web dryer of this invention is characterized by a substantially T-shaped duct having an outlet section extending lengthwise along the headers of said pair at said one side of them and having outlets at its opposite ends that open towards said air inlets, and an inlet section defining a communicating junction with said outlet section that is intermediate the ends thereof and having an inlet remote from said outlet section. There is a controllable burner near said inlet end of said inlet section for charging thereinto a combusting mixture of air and fuel. A diverter plate is mounted in said junction for flatwise swinging adjustment about an upright axis, for apportioning between said outlets the hot gases flowing thereto from the inlet section.

Preferably the opposite ends of said outlet section are spaced from the air inlets of the blowers for the headers of said pair, to permit air to be drawn into those blowers directly from the drying chamber along with heated air from said outlets.

Preferably, control of the temperatures in the headers of said pair is effected by a pair of temperature responsive sensors, one in each of those headers and each of which produces an output that varies in substantial correspondence with temperature in its header. The rate at which mixed fuel and air is fed to said burner is controlled by burner control means connected with the sensor in the lower header of said pair and responsive to its output. The position of said diverter plate is controlled by a servo that is connected with the other of said sensors to be responsive to its output.

Preferably the inlet section of the T-shaped duct extends transversely to the headers of said pair and is between them, and the burner is near the side of those headers that is opposite the one to which the blower air inlets open.

BRIEF DESCRIPTION OF THE DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
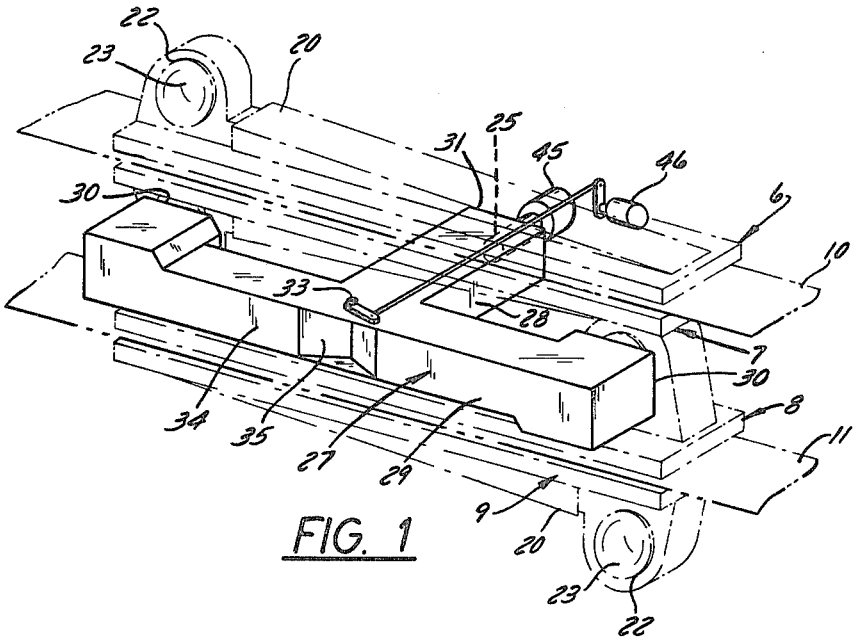
FIG. 1 is a more or less diagrammatic perspective view of apparatus housed within the dryer enclosure of a web dryer embodying the principles of this invention.
Figure 2:
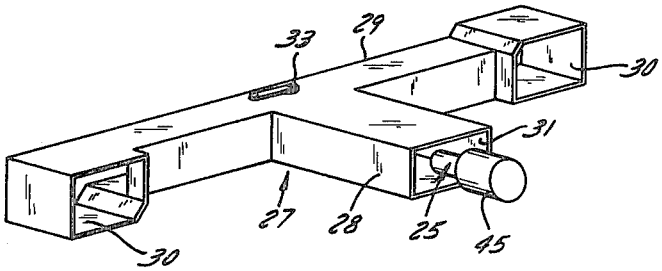
FIG. 2 is a perspective view of the burner and T-shaped duct by which air is heated and conducted to the pair of blowers that are between the web stretches.

A web dryer embodying the principles of this invention comprises a box-like dryer enclosure 5 in which there are four air bar assemblies 6, 7, 8, 9 that floatingly support two horizontally extending stretches 10, 11 of lengthwise moving web. The web material may be paper, foil, plastic film or the like, and the material is passed through the dryer enclosure to evaporate moisture from it or to dry coating or printing on one or both of its surfaces. The web stretches 10 and 11 may be those of two independent webs that are guided to pass through the enclosure for simultaneous drying, or the upper web stretch 10 may be continuous with the lower web stretch 11, in which case there will be known web guide means (not shown) outside the dryer enclosure 5 for constraining the web to follow a sinuous path in which it makes two passes through the enclosure. In either case the upper web stretch 10 overlies the lower stretch 11 and is spaced above it, and the two web stretches enter the enclosure 5 through respective slits 14, 15 in one of the enclosure end walls and leave the enclosure through similar slits 12, 13 in the opposite end wall.

Each of the air bar assemblies 6–9 is of the very compact type that is disclosed in detail in the aforesaid copending application. In general, each such assembly comprises an elongated header 20 that extends lengthwise of the web stretches 10, 11 and supports a plurality of air bars 21 which are spaced at intervals along the length of the header. The air bars 21 are generally conventional and can be of the type disclosed, for example, in U.S. Pat. No. 3,873,013, issued to P. H. Stibbe in 1975. The air bars 21 extend transversely to the headers 20 and thus widthwise relative to the web stretches 10, 11, the length of each air bar being at least equal to the width of a web. Midway between its ends each air bar has a ported connection with its header at which the interior of the air bar is communicated with the interior of the header so that pressure air from the header can be emitted from the air bar towards an adjacent surface of a web stretch.

For each header 20 there is a blower 22 that is mounted on a rear end of the header and projects from the header in the direction opposite to the one in which the air bars open. Each blower 22 has in its housing an air inlet 23 that opens to one side of its header. Each blower 22 of course forces pressure air into its header 20 that is emitted from the air bars on the header.

The air bar assemblies 9 and 7 are respectively mounted below the web stretches 11 and 10 to discharge pressure air upwardly against those web stretches for levitating them. The air bar assemblies 8 and 6 are respectively mounted above the web stretches 11 and 10 to discharge air downwardly against those stretches for steadying and guiding them. In addition to floatingly supporting and guiding the web stretches, the air streams discharged against those stretches from the several air bar assemblies effect rapid drying of the web; and to promote this drying function heated air is delivered to the air inlets 23 of the air bar assembly blowers as explained hereinafter.

At this point attention is directed to the very compact arrangement of the two middle air bar assemblies 7 and 8, which are between the web stretches 10 and 11. In this pair, the blower 22 at the rear end of each header 20 is adjacent to the front end of the other header and of course projects towards the other header. Since each header has substantial forward taper along its length, to have only a small vertical depth at its front end, the space between the middle air bar assemblies 7 and 8, bounded by their headers 20 and blowers 22, is a small one. This makes for a desirably low overall height of the drying apparatus, even though the enclosure 5 houses air bar assemblies that are stacked to accommodate two web stretches, but it also poses the problem solved by the present invention, namely that of accommodating in that limited space means for heating air to be supplied to the two middle air bar assemblies 7, 8 and for conducting the heated air to them.

According to the present invention, a fuel burner 25 for heating air to be supplied to the middle air bar assemblies 7, 8 is mounted on the back wall 26 of the enclosure 5, substantially at the center of that wall and projecting into the enclosure. The back wall 26 is the one at the side of the headers that is remote from the blower air inlets 23. In being substantially centered on that wall, the burner 25 is about midway between the blowers 22 of the middle air bar assemblies 7, 8 and likewise midway between their headers 20. The burner 25 is preferably a gas burner wherein combustion air is premixed with fuel gas before combustion and which is controllable as to its output.

The means for conducting heated air from the burner 25 to the middle air bar assemblies 7, 8 comprises a substantially T-shaped duct 27 that has an inlet section 28, which is between the headers 20 of the middle assemblies and extends transversely to them, and an outlet section 29 that extends substantially parallel to those headers, spaced to the side of them to which the blower inlets open. Each end of the outlet section 29 has an air outlet 30 therein that opens toward the air inlet 23 of its adjacent blower. The burner 25 projects substantially coaxially into the inlet section 28 of the T-shaped duct, which surrounds the burner with substantial clearance and has its inlet end spaced inward from the back wall 26 of the enclosure to provide an air inlet 31. Through this inlet 31 air from the interior of the housing can be drawn into the T-shaped duct for flow to the outlets 30 along with hot combustion gases from the burner.

Inside the T-shaped duct 27, at the junction of its inlet section 28 with its outlet section 29, there is a diverter plate 32 which is flatwise adjustably swingable from side to side for apportioning combustion gases from the burner 25 between the two branches of the outlet section 29 that extend to its respective outlets 30. The diverter plate is carried on a shaft 33 for flatwise swinging about an upright axis that is contained in the longitudinally extending central plane of the inlet section 28 and is adjacent to the outer side wall 34 of the outlet section 29. For smoother flow of air and combustion gas as it turns the corner from the inlet section 28 to each branch of the outlet section 29 of the T-shaped duct, the outer side wall 34 of the outlet section may have its portion 35 that is opposite the inlet section bent to a shallow inwardly projecting V, the apex of which is at the shaft 33 on which the diverter plate swings.

Figure 3:
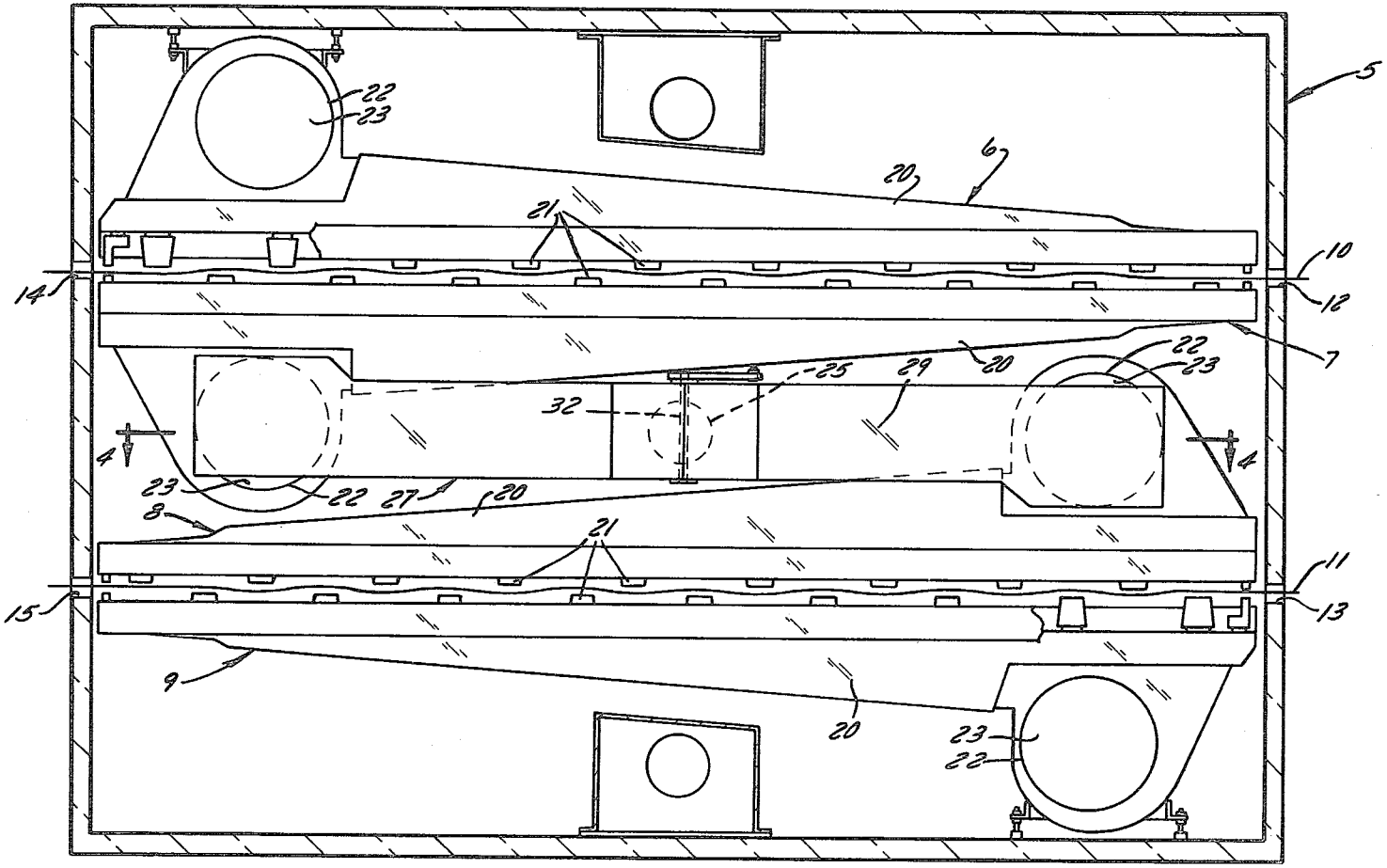
FIG. 3 is a view in vertical section of web drying apparatus of this invention, taken on a plane just inside one side wall of the dryer enclosure.
Figure 4:
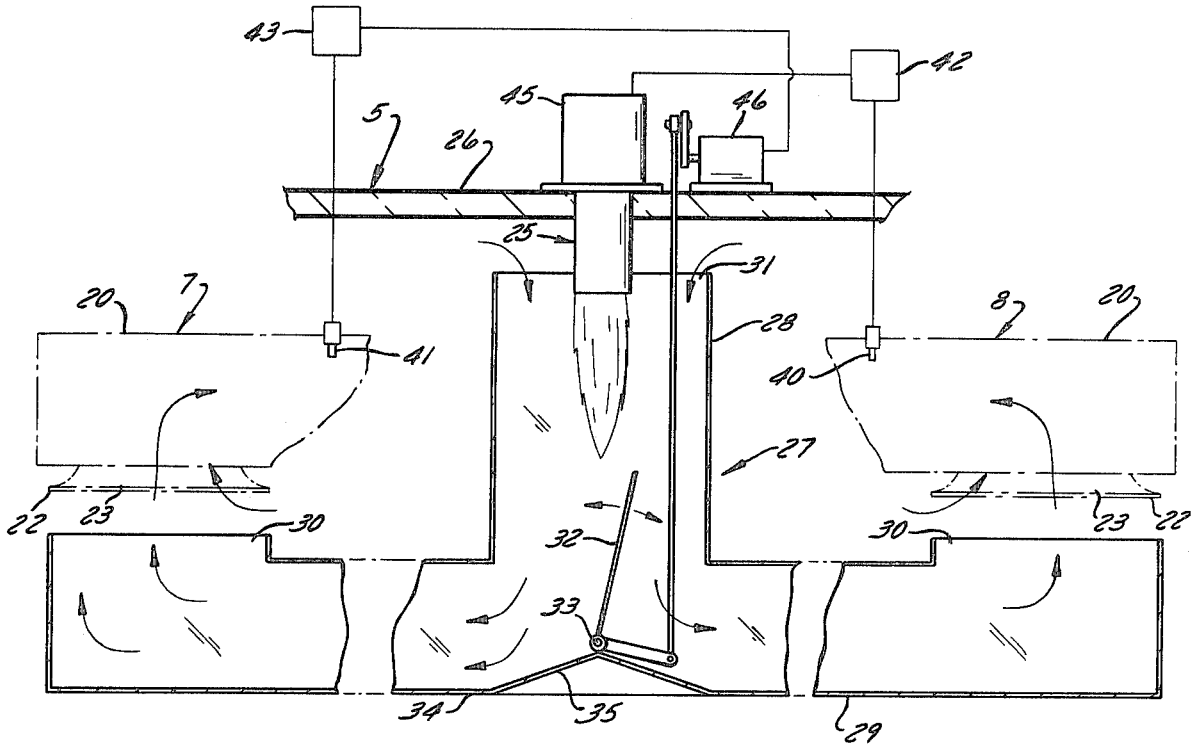
FIG. 4 is a fragmentary view in horizontal section taken substantially on the plane of line 4—4 in FIG. 3.
Figure 5:
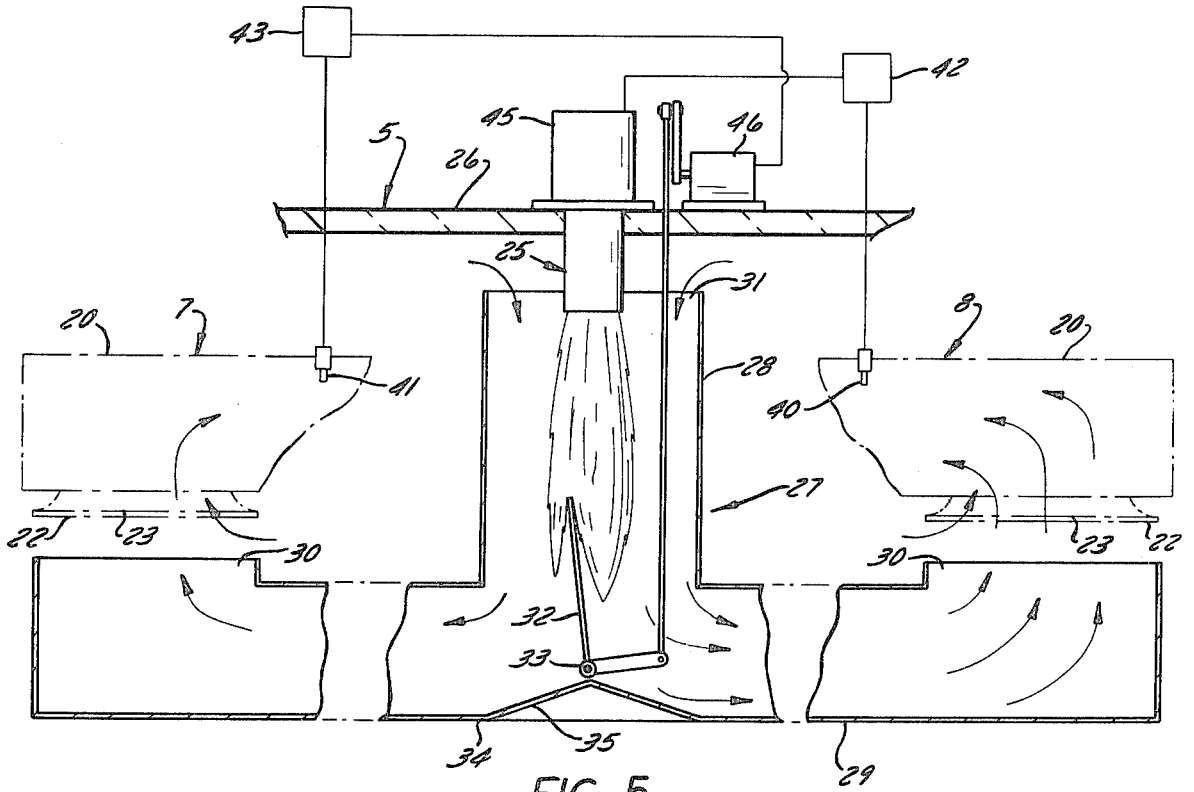
FIG. 5 is a view generally similar to FIG. 4 but showing the burner operating at higher output and the diverter plate in a different position of swinging adjustment than is illustrated in FIG. 4.

If the diverter plate 32 is swung to a centered position in which it is substantially parallel to the side walls of the inlet section, the combustion gases issuing from the burner 25 are divided equally between the two branches of the outlet section so that, apart from other influences, equal temperatures tend to be maintained in the headers 20 of the two middle air bar assemblies 7, 8. In that position the diverter plate literally splits the outer end portion of the burner flame when the burner is operating at high output. If the diverter plate 32 is swung to the right of its centered position, as illustrated in FIG. 4, the left branch of the outlet section receives a larger proportion of the hot burner gases than the right branch, and therefore if the air bar assemblies are arranged as shown in FIG. 3, the temperature in the header 20 of the upper middle air bar assembly 7 will be higher than in the header of the lower middle assembly 8. Conversely, if the diverter plate is shifted to the left of its centered position, as shown in FIG. 5, a greater portion of the combustion gases from the burner 25 will be directed into the right hand branch of the outlet section 29.

Since air from the interior of the dryer enclosure enters the inlet section 28 all around the burner, such air is in a substantially uniform proportion to burner combustion gases in both branches of the outlet section 29, irrespective of the position of the diverter plate 32. Because the outlet ends of the outlet section 29 are spaced from the inlets 23 of the blowers, each blower can draw a certain amount of air directly from the interior of the enclosure 5, along with the mixed air and combustion gases that it draws from its adjacent outlet 30 of the T-shaped duct, and therefore each blower maintains a substantially constant flow of pressure air to its associated air bars, notwithstanding changes in the amount of hot gas supplied to it from the T-shaped duct. It will be apparent that good mixing of the indrawn air and combustion gases takes place in the blower itself.

Usually—although not invariably—it will be desired to subject the lower web stretch 11 to higher temperatures than the upper web stretch 10, and it is unlikely that higher temperatures will be desired at the upper web stretch than at the lower one. The output of the burner 25 is therefore controlled in response to a sensor (thermostat) 40 in the header of the lower one 8 of the two middle air bar assemblies, and the output of the burner 25 is so adjusted as to maintain a desired temperature in that header. On the other hand, the diverter plate 32 is controlled in response to a sensor (thermostat) 41 in the header of the upper middle air bar assembly 7, and thus the diverter plate is always so positioned as to maintain a desired temperature in that header. Each of the sensors 40, 41 is connected in a control apparatus 42, 43, respectively, of a known kind, that provides for adjustment of the temperature to be maintained in the header, compares the output from its sensor with a set-point output corresponding to the desired temperature to be maintained, and issues a control output corresponding to the difference, if any, between the compared outputs. The control output from the apparatus 42 is fed to a burner control servo 45 that controls combustion at the burner 25, and the output of the apparatus 43 is similarly fed to a servo 46 that controls the position of the diverter plate 32.

It will be apparent that there is a substantial amount of space in the enclosure 5 above the uppermost air bar assembly 6 and below the lowermost air bar assembly 9, and therefore each of those assemblies can have its own burner and its own means for conducting heated air from its burner to its blower air inlet. For simplicity, the air heating and distributing means for the uppermost and lowermost air bar assemblies are not shown in the drawings, because each can comprise a burner mounted on the rear wall 26 of the enclosure 5 and a duct for conducting hot gases from its burner to the air inlet of its blower, in an arrangement that will be obvious from the foregoing description of the more specialized means for delivering heated air to the two middle air bar assemblies. Obviously, the fuel burner for each of the uppermost and lowermost air bar assemblies will be controlled as to its output in response to a thermostat in the header of the assembly.

From the foregoing description taken with the accompanying drawings, it will be apparent that this invention provides unusually compact web drying apparatus comprising a dryer enclosure in which there are stacked air bar assemblies whereby upper and lower web stretches are contactlessly supported, and wherein individual control is maintained over the temperature of the air issuing from each air bar assembly, notwithstanding that the two air bar assemblies that are between web stretches are both supplied with heated air from the same burner.

What is claimed as the invention is:

1. a web dryer comprising enclosure means defining a drying chamber wherein there are horizontally extending upper and lower stretches of lengthwise moving web that are in superimposed but vertically spaced relationship, said drying chamber having therein a plurality of elongated headers, each having ports at intervals along its length through which heated pressure gas can issue from its interior towards a stretch of web, there being a pair of said headers whereof one is directly below the upper stretch and has upwardly opening ports and the other is directly above the lower stretch and has downwardly opening ports, and every header having a blower at a rear end of it for feeding pressure gas into it, the headers of said pair being arranged with the blower of each adjacent to the front end of the other and with gas inlets of their blowers opening in the same direction to one side of them, said web dryer being characterized by:

A. a substantially T-shaped duct having
  (1) an outlet section extending lengthwise along the headers of said pair at said one side thereof and having outlets at its opposite ends that are respectively adjacent to said gas inlets, and
  (2) an inlet section defining a communicating junction with said outlet section that is intermediate the ends thereof and having an inlet end remote from said outlet section;

B. a controllable burner near said inlet end of said inlet section for charging thereinto a combusting mixture of air and fuel;

C. a diverter plate mounted in said junction for flatwise swinging adjustment about an upright axis, for apportioning between said outlets the hot gases flowing thereto from said inlet section; and D. the gas inlet of the blower for each header of said pair
  (1) being in substantially full communication with its adjacent one of said outlets, for withdrawal by the blower of substantially all of the hot gases flowing to that outlet, and
  (2) being also in substantially direct communication with said drying chamber, for withdrawal of gas therefrom at a rate complementary to the rate of withdrawal of hot gases from said outlet, whereby the blower feeds a substantially uniform flow of pressure gas into its header in all adjustments of the diverter plate.

2. The web dryer of claim 1, further characterized by:

D. a pair of temperature responsive sensors, each of which produces an output that varies in substantial correspondence with temperature at the sensor, there being one of said sensors in each of the headers of said pair;

E. burner control means for controlling the rate at which mixed fuel and air is fed to said burner, said burner control means being connected with one of said sensors to be responsive to the output thereof; and F. a servo for controlling the position of said diverter plate, said servo being connected with the other of said sensors to be responsive to the output thereof.

3. The web dryer of claim 1 wherein said outlets at the opposite ends of said outlet section are spaced from the respective gas inlets of the blowers, to permit gas to be drawn into the blowers directly from said drying chamber along with heated gases from said outlets.

4. The web dryer of claim 1 wherein said inlet section extends transversely to the headers of said pair and is between them, and said burner is near the opposite side of those headers.

5. The web dryer of claim 2 wherein said one of the sensors is in the header of said pair that is directly above the lower stretch of web and said other of the sensors is in the header of said pair that is directly below the upper stretch of web.

6. A web dryer comprising enclosure means defining a drying chamber wherein there are a pair of elongated headers, each having ports at intervals along its length through which heated pressure gas can issue towards a stretch of lengthwise moving web, each said header having a blower at a rear end of it for feeding pressure gas into it, and each said blower having a gas inlet, said web dryer being characterized by:

A. a duct having
  (1) an elongated outlet section with outlets at its opposite ends, each of which is adjacent to one of said gas inlets, and
  (2) an inlet section communicating with said outlet section intermediate the ends thereof and having an inlet end remote from said outlet section;

B. a controllable burner near said inlet end of said inlet section for charging thereinto a combusting mixture of air and fuel;

C. a movable diverter means between said inlet section and said outlet section for apportioning between said outlets the hot gases flowing to them from said inlet section; and D. means communicating the gas inlet of each said blower (1) substantially fully with its adjacent one of said outlets, so that the blower withdraws from that outlet substantially all of the hot gases flowing thereto, and (2) substantially directly with said drying chamber, so that the blower withdraws gas therefrom at a rate complementary to the rate at which it withdraws hot gases from its adjacent outlet and thus maintains a substantially uniform flow of pressure gas into its header in all adjustments of said diverter means.

7. The web dryer of claim 6 further characterized by:

D. a pair of temperature responsive sensors, each of which produces an output that varies in substantial correspondence with temperature at the sensor, there being one of said sensors in each of the headers of said pair;

E. burner control means for controlling the rate at which mixed fuel and air is fed to said burner, said burner control means being connected with one of said sensors to be responsive to the output thereof; and F. means for controlling the position of said movable diverter means, said last-recited means being connected with the other of said sensors to be responsive to the output thereof.

8. The web dryer of claim 7 wherein upper and lower stretches of web extend through the drying chamber in superimposed but vertically spaced relationship, and wherein the header having said one of the sensors therein is directly above the lower stretch of web and the header having the other of the two sensors therein is directly below the upper stretch of web.

9. The web dryer of claim 6 wherein said means communicating the gas inlet for each said blower with its adjacent one of said outlets and with said drying chamber comprises:

(1) a housing for the blower having an opening therein that defines said inlet, and (2) said outlet section being spaced from said housing for the blower and having an opening therein which provides said outlet and which faces towards said inlet and is aligned with the same.

10. The web dryer of claim 6 wherein the headers of said pair are arranged with the blower of each adjacent to the front end of the other and with the gas inlets of their blowers at one and the same side of both of them, further characterized by (1) said inlet section extending transversely to the headers of said pair and being between them, and (2) said burner being near the opposite side of those headers.

* * * * *